US010944243B2

(12) United States Patent
Döllgast et al.

(10) Patent No.: US 10,944,243 B2
(45) Date of Patent: Mar. 9, 2021

(54) METHOD FOR PRODUCING AN ARRESTER, AND ARRESTER

(71) Applicant: EPCOS AG, Munich (DE)

(72) Inventors: Bernhard Döllgast, Deutschlandsberg (AT); Georg Kügerl, Eibiswald (AT); Markus Puff, Graz (AT); Robert Hoffmann, Berlin (DE); Frank Werner, Berlin (DE)

(73) Assignee: EPCOS AG, Munich (DE)

( * ) Notice: Subject to any disclaimer, the term of this patent is extended or adjusted under 35 U.S.C. 154(b) by 278 days.

(21) Appl. No.: 16/086,575

(22) PCT Filed: Feb. 16, 2017

(86) PCT No.: PCT/EP2017/053502
§ 371 (c)(1),
(2) Date: Sep. 19, 2018

(87) PCT Pub. No.: WO2017/162376
PCT Pub. Date: Sep. 28, 2017

(65) Prior Publication Data

US 2019/0103730 A1 Apr. 4, 2019

(30) Foreign Application Priority Data

Mar. 24, 2016 (DE) ..... 10 2016 105 541.7

(51) Int. Cl.
*H01T 4/02* (2006.01)
*H01T 21/00* (2006.01)
(Continued)

(52) U.S. Cl.
CPC ..... *H01T 4/02* (2013.01); *H01T 1/24* (2013.01); *H01T 4/12* (2013.01); *H01T 21/00* (2013.01)

(58) Field of Classification Search
CPC .... H01T 1/00; H01T 1/24; H01T 4/02; H01T 4/12; H01T 13/20; H01T 13/28; H01T 21/00; H01T 21/06
See application file for complete search history.

(56) References Cited

U.S. PATENT DOCUMENTS 5,576,922 A * 11/1996 Sugaya ..... H01R 13/6666 338/234
6,606,230 B2 * 8/2003 Sawada ..... H01T 4/12 174/256
(Continued)

FOREIGN PATENT DOCUMENTS

DE 602005003250 T2 9/2008
DE 102008029094 A1 1/2009
(Continued)

*Primary Examiner* — Matthew V Nguyen
(74) *Attorney, Agent, or Firm* — Slater Matsil, LLP

(57) ABSTRACT

An arrester and a method for producing an arrester are disclosed. In an embodiment the method includes providing at least three green layers, wherein each layer includes at least one green sheet, introducing at least one hole into a first layer and applying an electrically conductive material for forming inner electrodes to a second layer and a third layer. The method further includes laminating the layers to form a green stack, wherein the first layer is arranged between the second layer and the third layer, separating the green stack into individual components and compacting the individual components, wherein laminating the layers and compacting the individual components are effected in a single temperature process by co-firing.

18 Claims, 3 Drawing Sheets

(51) Int. Cl.
*H01T 4/12* (2006.01)
*H01T 1/24* (2006.01)

(56) References Cited

U.S. PATENT DOCUMENTS

| | | | | |
|---|---|---|---|---|
| 7,099,131 | B2 | 8/2006 | Tominaga et al. | |
| 7,153,800 | B2 | 12/2006 | Umemoto et al. | |
| 8,080,927 | B2 | 12/2011 | Boy et al. | |
| 2004/0125530 | A1 | 7/2004 | Tominaga et al. | |
| 2009/0296294 | A1 | 12/2009 | Liu | |
| 2012/0019972 | A1* | 1/2012 | Zimmermann | H01T 4/12 361/118 |
| 2016/0141858 | A1 | 5/2016 | Hoffmann et al. | |

FOREIGN PATENT DOCUMENTS

| | | | | | |
|---|---|---|---|---|---|
| DE | 102013012842 | A1 | | 2/2015 | |
| JP | 11144835 | | * | 5/1999 | H01T 4/10 |
| JP | 2000091053 | A | | 3/2000 | |
| JP | 2000173743 | | * | 6/2000 | H01T 4/12 |
| JP | 2000243534 | A | | 9/2000 | |
| JP | 2004127614 | A | | 4/2004 | |
| JP | 2004214005 | A | | 7/2004 | |
| JP | 2009288008 | A | | 12/2009 | |
| JP | 2009295570 | A | | 12/2009 | |
| JP | 2015195119 | A | | 11/2015 | |
| WO | 2016149553 | A1 | | 9/2016 | |
| WO | WO-2017162735 | A1 | * | 9/2017 | H01T 4/12 |

* cited by examiner

METHOD FOR PRODUCING AN ARRESTER, AND ARRESTER

This patent application is a national phase filing under section 371 of PCT/EP2017/053502, filed Feb. 16, 2017, which claims the priority of German patent application 10 2016 105 541.7, filed Mar. 24, 2016, each of which is incorporated herein by reference in its entirety.

TECHNICAL FIELD

The present invention relates to a method for producing an arrester for protecting against overvoltages. In particular, this involves an arrester of multi-layered design. Furthermore, the invention specifies an arrester.

BACKGROUND

Conventional gas arresters generally consist of a perforated ceramic main body (generally a ring made of aluminum oxide), at the openings of which two metal caps are fitted. The metal caps are normally copper caps, which are bound to the ceramic by means of hard solder connections. Ceramic bodies, hard solder connection and metal caps are gas-tight, and therefore the atmosphere which prevails during the hard soldering process is enclosed hermetically in the interior of the gas arrester.

When applying an electrical voltage to the two metal caps, electrical flashover occurs within the gas arrester when an ignition voltage typical for the component configuration and gas composition is exceeded. In this way, electrical consumers can be protected against overvoltages.

Owing to the multiplicity of the individual components involved (ring, metallization layer, hard solder, metal caps), the design is complex and therefore accessible to automated production and in particular to miniaturization only to a limited extent. Firstly, the ceramic main bodies are to be produced in an individual design, for example, by means of pressing and sintering. A metallization layer suitable for hard soldering is to be applied to said main bodies, for example, by screen printing and firing. The metallized main body, hard solder and metal caps then have to be assembled with exact geometry and subjected to soldering in a further temperature step.

SUMMARY OF THE INVENTION

Embodiments provide an improved method for producing an arrester. Further embodiments provide an improved arrester.

According to one embodiment, a method for producing an arrester is described. In particular, the method produces a gas arrester of multi-layered design. The method produces a multiplicity of arresters (multiple arrangement). The method comprises the following steps: providing at least three green layers. Preferably, precisely three layers are provided. Each layer can comprise one or more green sheets. By way of example, a layer comprises 10, 20 or more green sheets. A green sheet may have a thickness of, for example, 40 μm. However, other numbers and thicknesses of green sheets are also conceivable—depending on the desired quality of the arrester; —introducing at least one hole into a first layer. The hole is introduced by means of lasering or punching, for example. The hole penetrates completely through the first layer. It is also possible for more than one hole to be introduced into the first layer. Preferably, the first layer comprises a multiplicity of holes. The number of holes preferably corresponds to the number of individual components which are produced at the end of the production method by a singulation step; applying an electrically conductive material for forming inner electrodes to a second layer and a third layer. By way of example, the electrically conductive material can comprise copper (Cu), tungsten (W) or nickel (Ni). The electrically conductive material is preferably applied in a predetermined pattern to an outer face of the second layer and of the third layer. The electrically conductive material is applied to the second layer and the third layer by means of screen printing, for example; laminating the layers to form a stack. Here, the first layer is arranged between the second layer and the third layer. In particular, the second layer and the third layer are laminated with the printed outer face inward onto the first layer to form the stack. For this purpose, the layers are exposed to moderate temperature and pressure. The lamination is effected in particular in the green (unsintered) state through the application of pressure and temperature, depending on the organic system at approximately 50° to 100° C. The printing pattern for the electrically conductive material is chosen here in such a way that, in the laminated stack, the hole in the first layer is covered at least partially on both sides with the electrically conductive material; separating the green stack into individual components. This is affected by means of cutting or sawing, for example; compacting the individual components. For this purpose, the individual components are exposed to a certain temperature and atmosphere.

The lamination of the layers and the compaction of the individual components are effected in a single temperature process by co-firing. Inner electrodes and gas discharge region are consequently produced in a common production step. This provides a simple and cost-effective method. The method furthermore makes it possible to simultaneously produce a multiplicity of individual components of small size. This provides a particularly cost-effective and efficient method.

According to one exemplary embodiment, in a further method step, a metal paste is applied to at least a partial region of the outer face, for example, the two end faces, of the respective individual component. The metal paste preferably comprises copper or nickel. Then, the metal paste is fired for forming at least one outer electrode. By way of example, the outer electrode is configured in the form of a metal cap.

In this way, the inner electrodes can be reliably contacted in a simple manner. The type and geometry of the outer metallization are preferably chosen here in such a way that a surface-mountable component is formed. This method step too is effected—together with the lamination of the layers and the compaction of the individual components—in a single temperature process by co-firing. This provides a simple and efficient method.

According to one exemplary embodiment, the layers comprise a ceramic material. The layers have the same ceramic composition. The ceramic is distinguished by a low dielectric constant and good sintering properties.

By way of example, the layers may comprise $Al_2O_3$. Furthermore, the layers may comprise $SiO_2$ as sintering aid. Any other ceramic which can be sintered together with the electrode is also conceivable, however.

According to one exemplary embodiment, the individual components are compacted by means of debindering and sintering of the individual components under a defined temperature and atmosphere. In this case, the layer stack comprising ceramic material is exposed to a predetermined temperature of, for example, 900° C. to 1200° C. The debindering and sintering are effected in one temperature process, and therefore further temperature processes are superfluous.

According to one exemplary embodiment, the layers comprise glass. The layers may consist predominantly of glass or, in addition to glass, also comprise a ceramic proportion. In this case, the individual components are compacted by way of a glass transition. In this case, the stack is exposed to a temperature which is lower than the temperature used for sintering. In this case, it is also possible to use electrode materials having a lower melting temperature.

A glass as sintering aid reduces, in particular, the sintering temperature and brings about more complete compaction. It is important when selecting glass that the shape of the layers is retained during the sintering.

According to one exemplary embodiment, after the singulation, the electrically conductive material protrudes at at least one side edge of the respective individual component. In this way, the individual component can be connected to an external contact-making means.

According to one exemplary embodiment, an activation material may be provided in the first layer. The activation material is arranged at least partially in the hole. The activation material may be introduced into the first layer before the provision of the hole. As an alternative thereto, the activation material may also be provided on the side walls of the first layer which delimit the hole after the provision of the hole. The activation material preferably comprises graphite. The activation material is provided for facilitating the ignition of the gas and for conducting the sparks. A particularly effective arrester can thus be provided by the method.

According to a further aspect, the invention provides an arrester for protecting against overvoltages. The arrester is in particular a gas arrester of multi-layered design. The arrester is preferably produced by the method described above. All of the features which have been described in conjunction with the method also apply to the arrester, and vice versa.

The arrester comprises a plurality of layers arranged one above another, in particular three layers. The layers may comprise a plurality of individual layers. The arrester comprises at least one cavity. The cavity leads through at least one layer, in particular the cavity penetrates completely through the layer. The layers comprise a cover layer and a base layer. A main layer, which comprises the cavity, is formed between the cover layer and the base layer. The cover layer and the base layer delimit the cavity toward the bottom and top. At least one inner electrode is arranged in each case on the cover layer and the base layer. The inner electrodes adjoin the cavity. The cavity is surrounded or closed completely by the cover layer and the base layer.

The compact arrangement in the form of a multi-layered component makes it possible to provide a small, miniaturized component. Through the formation of the inner electrodes on individual layers, the electrodes can be arranged freely. This makes it possible for the component to be adapted to an extremely wide variety of installation situations.

According to one exemplary embodiment, the layers comprise a ceramic material. As an alternative or in addition, the layers may comprise glass. These materials are distinguished by a low dielectric constant and furthermore can be readily exposed to high temperatures, for example, during a sintering step.

According to one exemplary embodiment, the inner electrodes have an areal form. By way of example, the inner electrodes are formed on the respective layer in the form of a strip. The inner electrodes preferably completely cover the cavity toward the bottom and top.

By virtue of the areal electrodes, the current load in the electrode is reduced and heat losses are dissipated more effectively. The area should therefore be as large as possible. On the other hand, a narrow electrode leads to a field boosting and thus to easier ignition of the flashover.

BRIEF DESCRIPTION OF THE DRAWINGS

The drawings which are described hereinbelow are not to be understood as true to scale. Instead, individual dimensions may be shown on an enlarged scale, on a reduced scale or else in distorted form for better illustration.

Elements which are equal to one another or which perform the same function are denoted by identical reference signs.

In the drawings:

FIG. 1 shows a sectional illustration of an arrester according to a first exemplary embodiment;

FIG. 2 shows a plan view onto the arrester as shown in FIG. 1;

FIG. 3 shows a sectional illustration of an arrester according to a second exemplary embodiment;

FIG. 4 shows a plan view onto the arrester as shown in FIG. 3;

FIG. 5 shows method steps for the production of an arrester; and

FIG. 6 shows a method step for the production of an arrester.

DETAILED DESCRIPTION OF ILLUSTRATIVE EMBODIMENTS

Figure 1:
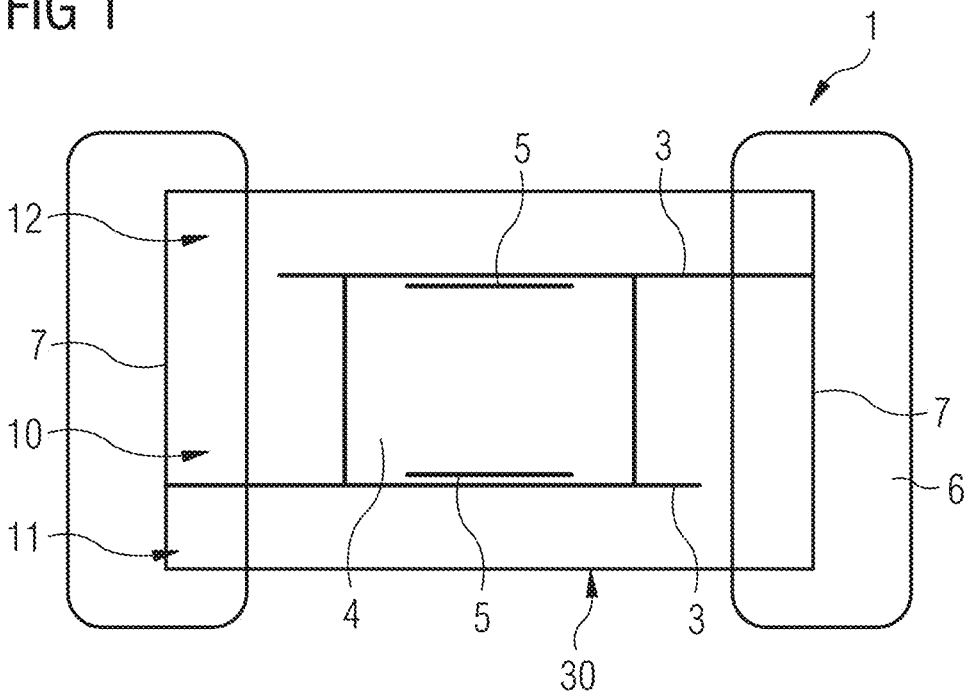
Figure 2:
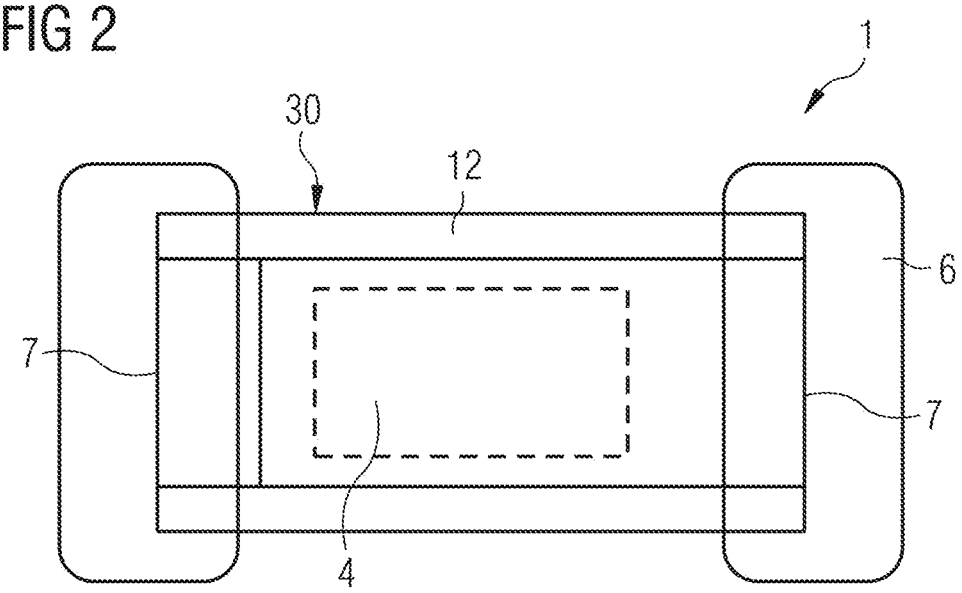

FIGS. 1 and 2 show an arrester 1 for protecting against overvoltages according to a first exemplary embodiment. The arrester 1 is in particular a gas arrester of multi-layered design.

The arrester 1 comprises a main body 30. The main body 30 has a multi-layered construction. The main body 30 comprises a first layer 10 or main layer 10. The main body 30 comprises a second layer 11 or base layer 11. The main body 30 comprises a third layer 12 or cover layer 12.

The layers 10, 11, 12 may each be produced from one or more sheets, in particular green sheets, arranged one above another. By way of example, one or more of the layers 10, 11, 12 are each formed from a multiplicity of sheets, for example, in each case from 20 sheets. In this case, the layers 10, 11, 12 are each formed as sheet assemblies. However, the layers 10, 11, 12 may each also be formed from only one sheet. The number of sheets used depends on the thickness of the sheets and on the required properties of the arrester 1. The layers 10, 11, 12 are arranged one above another, with the main layer 10 being arranged between the base layer 11 and the cover layer 12.

The layers 10, 11, 12 preferably have the same material composition. In addition to an inorganic binder, the layers 10, 11, 12 comprise a material which is compacted readily at high temperatures. By way of example, the layers 10, 11, 12 comprise a ceramic. The ceramic is distinguished by a low dielectric constant and good sintering properties. As an alternative or in addition, the layers 10, 11, 12 may also comprise glass.

The main layer 10 comprises a hole or a cavity 4. The cavity 4 penetrates completely through the main layer 10. The cavity 4 is preferably closed completely toward the outside. In particular, the cavity 4 is delimited toward the top and bottom by the base layer 11 and the cover layer 12.

The shape of the cavity 4 is preferably translationally invariant with respect to the stacking direction of the layers 10, 11, 12. In particular, the cavity 4 has the shape of a right cylinder. In this case, the side walls delimiting the cavity 4 extend perpendicularly to a basic area, in particular perpendicularly to a base area or top area delimiting the cavity 4. The cavity 4 has in particular a basic area parallel to the layer planes and a height along the stacking direction of the layers 10, 11, 12. The height of the cavity 4 corresponds in particular to the thickness of the main layer 10.

The cavity 4 is filled with a gas. The type of gas depends on an atmosphere during the production of the arrester 1, in particular on a sintering atmosphere during the sintering of the layers 10, 11, 12. By way of example, sintering is carried out with exclusion of oxygen. By way of example, halides may also be added to the atmosphere. By way of example, the gas contains nitrogen.

An activation material 5, for example, graphite, may furthermore be arranged in the cavity 4, in particular on the side walls of the main layer 10 which delimit the cavity 4. The formation of an arc can be assisted by the activation material 5. The activation material 5 thus serves as an ignition aid. The activation material 5 may cover merely partial regions of the side walls as narrow strips, or else the complete side walls of the cavity 4.

The arrester 1 furthermore comprises inner electrodes 3. The inner electrodes 3 are arranged in each case on the cover layer 12 and the base layer 11. The cover layer 12 and the base layer 11 thus represent electrode-carrying layers. By way of example, the inner electrodes 3 comprise copper, tungsten and/or nickel.

The inner electrodes 3 extend parallel to the layers 10, 11, 12. In this exemplary embodiment, the inner electrodes 3 extend in an alternating manner as far as a side edge 7 of the main body 30. This means that an inner electrode 3 is guided to a first side edge 7 (right-hand side edge in FIG. 1), while the inner electrode 3 in question does not extend as far as the opposite second side edge 7 of the main body 30. A further inner electrode 3 extends as far as the second side edge 7 (left-hand side edge in FIG. 1), but not as far as the opposite first side edge 7. However, inner electrodes 3 which are not guided as far as the side edge 7 at all but instead serve as conductive electrodes for the flashover (not shown explicitly) are also conceivable.

The inner electrodes 3 delimit the cavity 4 toward the top or bottom. In this respect, the inner electrodes 3 can have an areal form, and therefore they cover the cavity 4 completely from the top and/or bottom. In other words, the respective inner electrode 3 can completely cover the layer 11, 12 on which it is arranged at least in the region of the cavity 4. As an alternative thereto, it is also possible for at least one of the inner electrodes 3 to be formed merely as a narrow line and to protrude into the cavity 4 at a top side and/or at a bottom side of the cavity 4.

For connecting the inner electrodes 3, outer electrodes 6, for example, in the form of metal caps, are arranged on the end sides of the main body 30. The outer electrodes 6 preferably comprise copper. In this exemplary embodiment, the outer electrodes 6 are arranged at the opposing end sides of the main body 30. The outer electrodes 6 are preferably attached to the main body 30 by means of hard soldering. The inner electrodes 3 are alternately connected to the outer electrodes 6 for contacting the arrester 1.

The arrester 1 is preferably in the form of an SMD component, i.e., in the form of a surface-mountable component. By way of example, the arrester 1 is formed for assembly on a printed circuit board.

Figure 3:
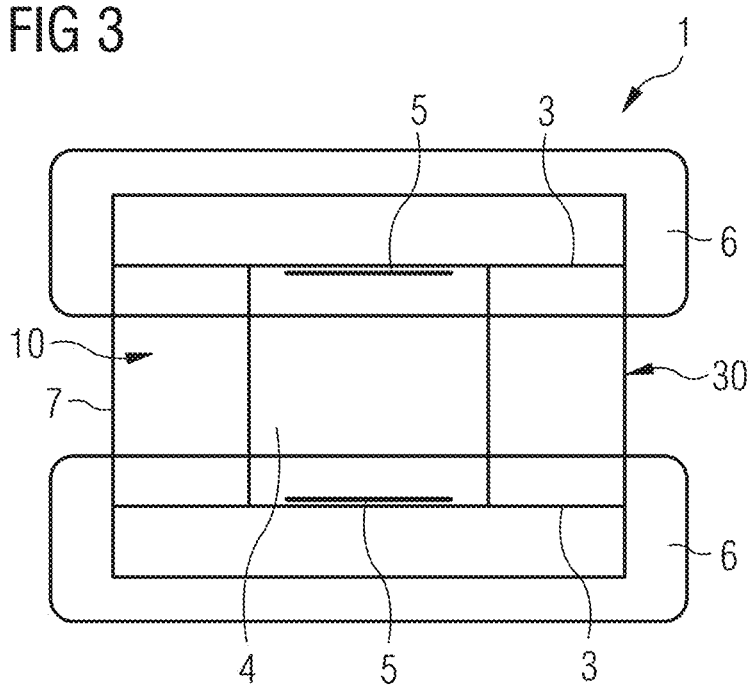
Figure 4:
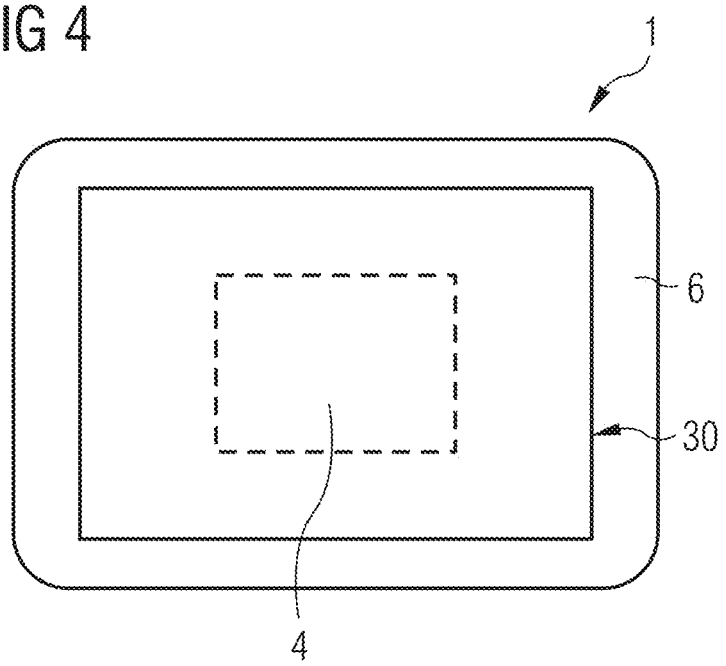

FIGS. 3 and 4 show an arrester 1 for protecting against overvoltages according to a second exemplary embodiment. Hereinbelow, only the differences between the two exemplary embodiments will be explained.

In contrast to the arrester 1 shown in FIGS. 1 and 2, the inner electrodes 3 are guided on both sides as far as the side edge 7 of the main body 30. In other words, each inner electrode 3 extends as far as the two side edges 7 of the main body 30. It is thus possible to take alternative installation situations for the arrester 1 into consideration.

In this exemplary embodiment, the outer electrodes 6 are not arranged on the end sides of the main body 30 for contacting the inner electrodes 3. Since the inner electrodes 3 protrude on both sides as far as the edge of the main body 30, the outer electrodes 5 are formed on the opposing longitudinal sides or main faces of the main body 30. In particular, the outer electrodes 6 are applied to the main body 30 from above and below in the form of metal caps. In this case, the outer electrodes 6 protrude partially onto the end sides of the main body 30 for connecting the inner electrodes 3.

For the rest, the features described in conjunction with FIGS. 1 and 2 also apply to the arrester 1 shown in FIGS. 3 and 4.

Figure 5:
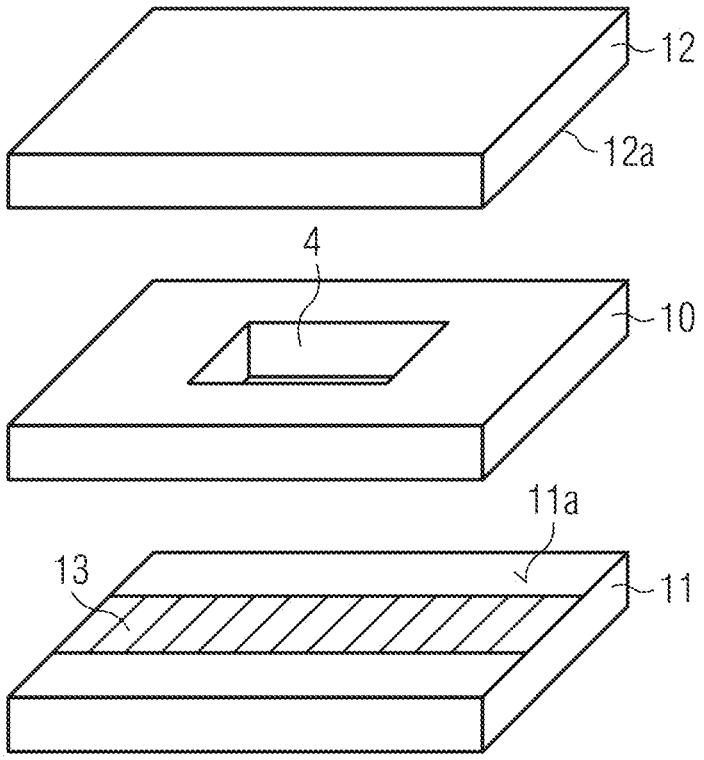
Figure 6:
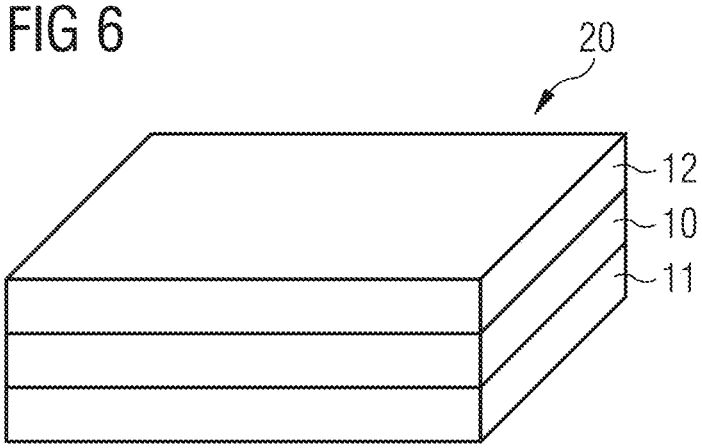

FIGS. 5 and 6 show method steps for the production of an arrester. The method will preferably produce an arrester 1 as shown in FIGS. 1 to 4.

Firstly, three green layers 10, 11, 12 are provided. The layers 10, 11, 12 comprise the same material. In this case, at least one sheet is provided for each of the green layers 10, 11, 12. These are preferably green sheets, for example, ceramic green sheets.

The sheets preferably comprise a ceramic powder. A suitable ceramic base material here are all ceramics whose sintering temperature lies below the melting temperature of the electrode materials used (in particular copper, tungsten and/or nickel) and which have a sufficient mechanical and electrical stability after the sintering. As an alternative thereto, glass-filled sheets are also conceivable.

It is also possible for a plurality of sheets to be provided for each layer 10, 11, 12. The first layer 10 or main layer 10 of the arrester 1 is preferably formed from a plurality of first sheets. The second layer 11 or base layer 11 of the arrester 1 is preferably formed from a plurality of second sheets. The third layer 12 or cover layer 12 of the arrester 1 is preferably formed from a plurality of third sheets. The number of sheets used depends on the thickness of the sheets and on the required properties of the arrester 1. By way of example, the main layer 10 can comprise up to 20 sheets or more, with a thickness of, for example, in each case 40 μm.

Thereafter, at least one hole 4 is introduced into the first layer 10, for example, by lasering or punching. The hole 4 is provided to form the later gas inner space. The hole 4 penetrates through the first layer 10 and in particular the multiplicity of sheets of the first layer 10 completely.

In an optional step, an activation material 5 may be introduced into the hole 4. In this case, by way of example, a graphite paste is introduced onto the side walls of the first layer 10, which delimit the hole 4.

As an alternative thereto, the activation material 5 may also already be introduced during the construction of the first layer 10, before the hole 4 is produced. In particular, the activation material 5 may be introduced in this case between individual sheets of the first layer 10. In this case, a ring made up of activation material 5 is formed on the walls of the hole 4 during the formation of the hole 4.

An electrically conductive material 13, in particular a metal paste, for forming inner electrodes 3 is then applied to the second layer 11 and the third layer 12. The material 13 is applied to an outer face 11*a*, 12*a* of the respective layer 11, 12. The material 13 is preferably printed onto the second and third layer 11, 12, e.g., by means of screen printing. By way of example, the electrically conductive material 13 may comprise copper, tungsten or nickel.

The printing is effected in the form of certain patterns. By way of example, the electrically conductive material 13 can be applied as a continuous strip. The printing patterns are chosen in such a way that, after later singulation of the stack, the metal regions protrude at least partially at the side edge 7, and are thus accessible for electrical contacting from the outside. Furthermore, the printing patterns are chosen in such a way that the at least one hole 4 in the first layer 10 is covered on both sides, i.e., from the top and bottom, with the electrically conductive material 13.

Then, the second layer 11 and the third layer 12 are laminated with the printed outer face 11*a*, 12*a* inward onto the first layer 10 to form a stack 20 (see FIG. 6). This lamination is effected in the green state of the layers under pressure and moderate temperature. By way of example, the lamination is effected at a temperature of 80° C. to 100° C.

In a further step, the ceramic green stacks 20 are separated into individual components 30 (main bodies 30). This is effected by means of cutting or sawing, for example. The individual components 30 are then compacted in a single step under a defined temperature and atmosphere. If the layers 10, 11, 12 comprise a ceramic, the individual components 30 are debindered and sintered under a defined temperature and atmosphere in this step.

Sintering is preferably carried out with exclusion of oxygen. In this case, the sintering temperature is dependent on the material used, and may lie between 900° C. and 1200° C. If glass-filled sheets are used, the compaction step is realized by way of a glass transition, rather than by way of sintering. In this case, the individual component 30 is exposed to a temperature which is lower than the temperature used for sintering.

In a last step, a metal paste is applied to at least a partial region of the outer face of the respective individual component 30. Depending on the configuration of the inner electrodes 3, the metal paste may be applied to the end faces or the main faces of the respective individual component 30 (see FIGS. 1 to 4). The metal paste is then fired for forming the outer electrodes 6. The type and geometry of the outer electrodes 6 are chosen in such a way that a surface-mountable component similar to a multi-layered capacitor (MLLC) is formed.

The lamination of the layers 10, 11, 12, the compaction of the individual components 30, and the firing are effected in a single temperature process by co-firing. Further temperature processes, which complicate the method, are superfluous.

The advantage compared to conventional gas arresters consists in the fact that no individual elements, but instead multiple arrangements, need to be processed. This allows for a high degree of automation and also makes it possible to produce very small, miniaturized designs. Construction by means of individual sheets furthermore makes it possible to arrange the inner electrodes 3 freely. It is thus possible to combine an areal inner electrode 3 and electrodes which protrude into the hole 4 only as a narrow line.

Electrodes which are not guided outward to the side edges 7 and serve as conductive electrodes for the flashover are also possible.

The description of the subjects specified here is not limited to the individual specific embodiments. Instead, the features of the individual embodiments—as far as technically feasible—can be combined with one another as desired.

The invention claimed is:

1. A method for producing an arrester, the method comprising:

providing at least three green layers, wherein each layer comprises at least one green sheet;

introducing at least one hole into a first layer;

applying an electrically conductive material for forming inner electrodes to a second layer and a third layer;

laminating the layers to form a green stack, wherein the first layer is arranged between the second layer and the third layer;

separating the green stack into individual components; and compacting the individual components, wherein laminating the layers and compacting the individual components are effected in a single temperature process by co-firing.

2. The method according to claim 1, further comprising:

applying a metal paste to at least a partial region of an outer face of the individual components; and firing the metal paste for forming at least one outer electrode.

3. The method according to claim 1, wherein the layers have the same material composition.

4. The method according to claim 1, wherein the layers comprise a ceramic material.

5. The method according to claim 4, wherein the individual components are compacted by debindering and sintering of the individual components under a defined temperature and atmosphere.

6. The method according to claim 1, wherein the layers comprise glass.

7. The method according to claim 6, wherein the individual components are compacted by way of a glass transition.

8. The method according to claim 1, wherein the electrically conductive material is applied in a predetermined pattern to outer faces of the second layer and the third layer, and wherein the second layer and the third layer are laminated with the printed outer faces inward onto the first layer to form the green stack.

9. The method according to claim 8, wherein the pattern is chosen in such a way that the at least one hole in the first layer is covered at least partially on both sides with the electrically conductive material.

10. The method according to claim 1, wherein the electrically conductive material is applied to the second layer and the third layer by screen printing.

11. The method according to claim 1, wherein, after separation, the electrically conductive material protrudes at at least one side edge of each individual component.

12. The method according to claim 1, further comprising providing an activation material in the first layer, wherein the activation material is arranged at least partially in the hole.

13. An arrester for protecting against overvoltages comprising:

a plurality of layers arranged one above another; and at least one cavity which leads through at least one layer, wherein the arrester comprises inner electrodes, which adjoin the cavity, and wherein the arrester is produced according to the method of claim 1.

14. The arrester according to claim 13, wherein the layers comprise a cover layer and a base layer, which delimit the cavity toward a bottom and a top, and wherein the inner electrodes are arranged on the cover layer and the base layer.

15. The arrester according to claim 14, wherein the inner electrodes have an areal form and completely cover the cavity toward the bottom and the top.

16. The arrester according to claim 13, wherein the layers comprise a ceramic material and/or glass.

17. A method for producing an arrester, the method comprising:

providing at least three green layers, wherein each layer comprises at least one green sheet;

introducing at least one hole into a first layer;

applying an electrically conductive material for forming inner electrodes to a second layer and a third layer;

laminating the layers to form a green stack, wherein the first layer is arranged between the second layer and the third layer;

separating the green stack into individual components;

applying a metal paste to at least a partial region of an outer face of each individual component; and compacting the individual components, wherein laminating the layers, compacting the individual components and firing the metal paste are effected in a single temperature process by co-firing.

18. A method for producing an arrester, the method comprising:

providing at least three green layers, wherein each layer comprises at least one green sheet;

introducing at least one hole into a first layer;

providing an activation material in the first layer, wherein the activation material is arranged at least partially in the hole;

applying an electrically conductive material for forming inner electrodes to a second layer and a third layer;

laminating the layers to form a green stack, wherein the first layer is arranged between the second layer and the third layer;

separating the green stack into individual components; and compacting the individual components, wherein laminating the layers and compacting the individual components are effected in a single temperature process by co-firing.

* * * * *